United States Patent [19]

Wünning

[11] Patent Number: 5,007,826

[45] Date of Patent: Apr. 16, 1991

[54] ROLLER HEARTH FURNACE FOR THE HEAT TREATING OF METAL AND CERAMIC PARTS

[76] Inventor: Joachim Wünning, Berghalde 20, 7250 Leonberg 7, Fed. Rep. of Germany

[21] Appl. No.: 351,794

[22] Filed: May 15, 1989

[30] Foreign Application Priority Data

May 14, 1988 [DE] Fed. Rep. of Germany ..... 3816503
Apr. 4, 1989 [EP] European Pat. Off. ..... 89105863.8

[51] Int. Cl.[5] ..... F27D 3/00

[52] U.S. Cl. ..... 432/121; 432/244; 432/246

[58] Field of Search ..... 432/238, 121, 244, 266, 432/241, 246, 239, 76, 141

[56] References Cited

U.S. PATENT DOCUMENTS 3,608,876 9/1971 Leaich .
3,914,099 10/1975 Cable et al. ..... 432/121
4,225,197 9/1980 Mantegani ..... 432/121 X

FOREIGN PATENT DOCUMENTS 3510801 2/1986 Fed. Rep. of Germany .
2840282 4/1986 Fed. Rep. of Germany .

*Primary Examiner*—Henry A. Bennet
*Attorney, Agent, or Firm*—Burns, Doane, Swecker & Mathis

[57] ABSTRACT

A roller hearth furnace comprises a thermally insulated housing forming a heating space therein and a plurality of roller modules removably mounted in the housing for transporting parts longitudinally through the heating space. The modules are successively arranged along the direction of transport of the parts. Each module includes a pair of transversely spaced bearing beams removably supported in recesses of the housing, and a plurality of rotatably driven rollers having their ends supported in the bearing beams.

20 Claims, 7 Drawing Sheets

Fig. 1
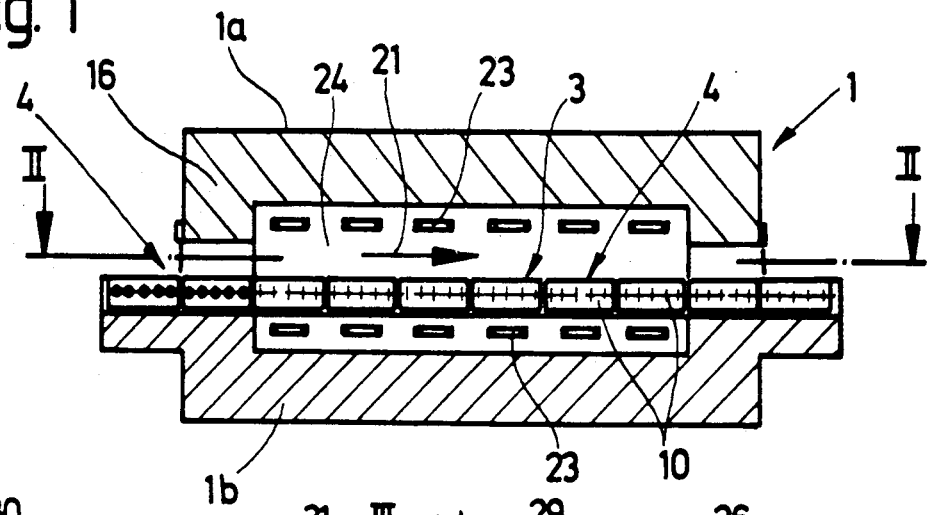
Fig. 2
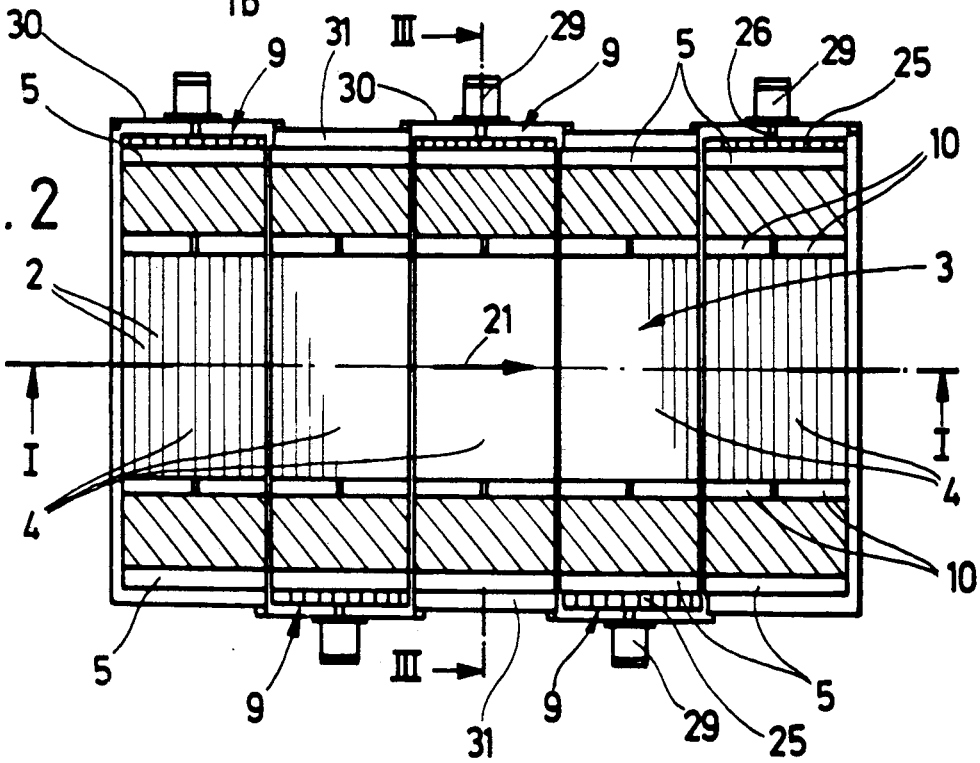
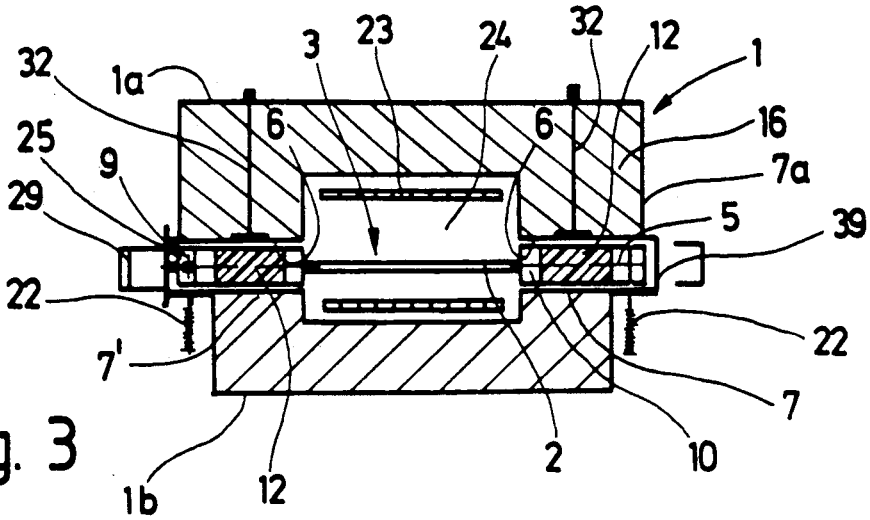
Fig. 3

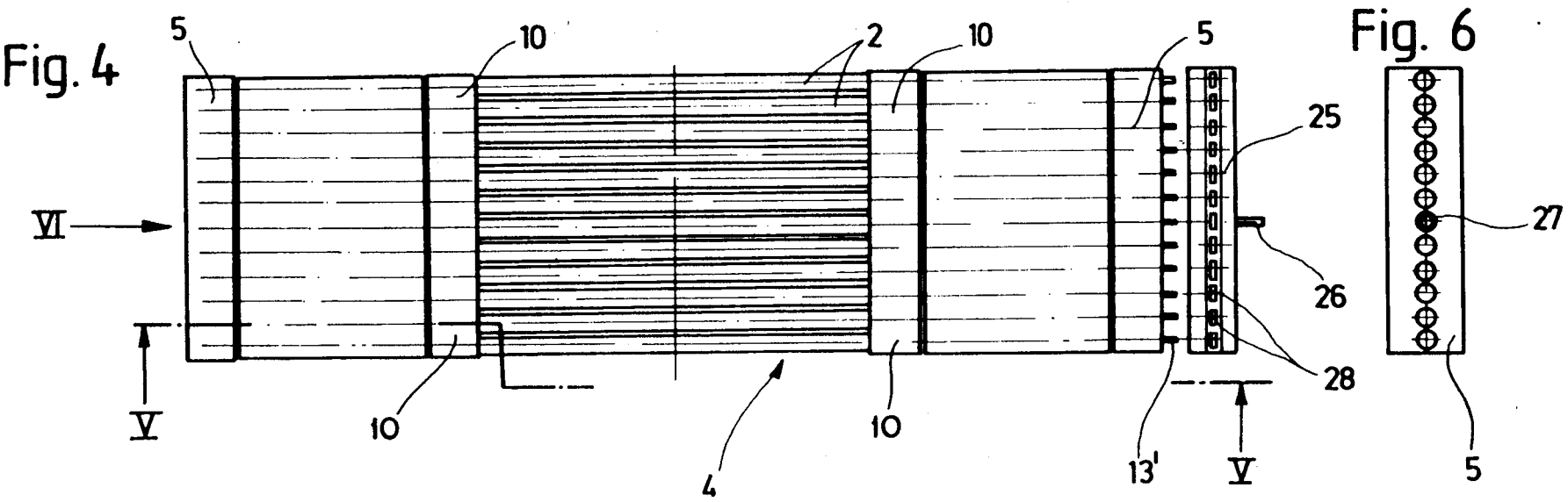
Fig. 6
27
5
25
26
28
V
13'
5
10
2
10
4
10
10
5
V
VI
Fig. 4
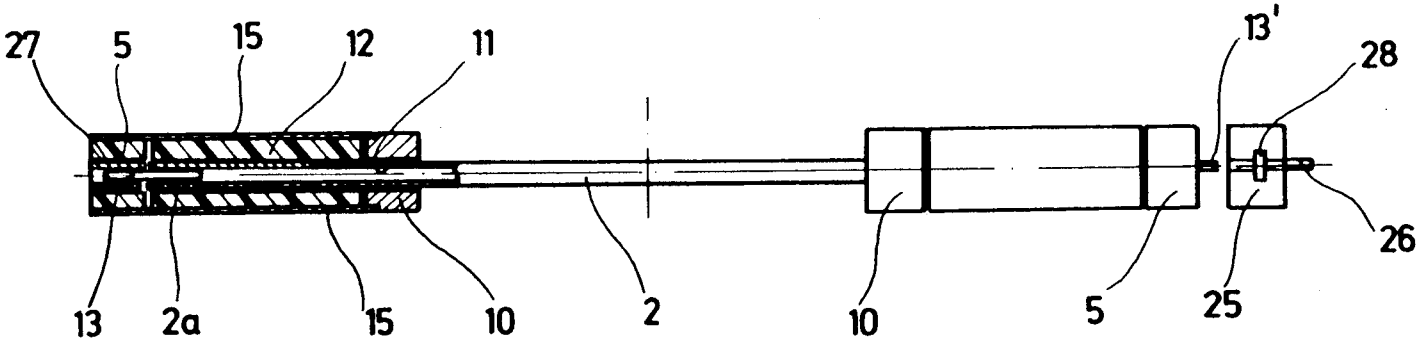
28
26
13'
25
5
10
2
11
10
12
15
15
2a
5
13
27
Fig. 5

ROLLER HEARTH FURNACE FOR THE HEAT TREATING OF METAL AND CERAMIC PARTS

BACKGROUND OF THE INVENTION

The invention concerns a roller hearth furnace for the heat treatment of parts passing therethrough. The furnace includes a thermally insulated housing forming a heating space therein. A plurality of rotatable rollers are mounted in the heated spaced and extend in a direction transversely to the direction of travel of parts through the heating space. The parts ride on the rollers, and the rollers are rotatably driven to transport the parts.

A roller hearth furnace of that type is known, for example, from German Patent DE-28 40 282. In that known configuration refractory bricks are built into the refractory lining of the opposing longitudinal walls of the roller hearth furnace, and are provided with transversely aligned openings to contain the rollers. The rollers can then be inserted into the aligned openings from outside of the furnace and removed in a similar manner, if repairs are necessary.

In order to prevent the loss of gas and heat through the openings in the refractory bricks, the diameter of which must be greater than that of the rollers, cavities are provided in the refractory bricks, into which an insulating and refractory material is pressed, such as for example kaolin wool, which may then contact the roll periphery tightly.

A fundamental disadvantage of such roller hearth configurations results from the fact that for reasons of mechanical strength the diameter of the rollers themselves cannot be reduced below a certain value and the spacing between the rollers may also not be arbitrarily small. Thus, the openings in the longitudinal walls of the furnace constitute a considerable weakening of the walls, i.e., relatively narrow web portions of the walls remain in between the openings which must withstand the various loads such as the outwardly directed tensile stress under which the rollers are constantly placed. To maximize the strength of those webs, they can be provided with a certain minimum width, but then a corresponding spacing between the rollers will also result. This spacing between the rollers and their diameter determines the size of the parts to be treated (to prevent the parts from falling between the rollers) unless separate carrier plates for the parts are provided. The disadvantage in using plates involves the fact that the mass of the carrier plates must also be heated during their travel through the roller hearth furnace, thereby causing an unnecessary loss of heat.

In other types of industrial furnaces, for example the so-called tunnel furnaces (DE 35 10 801), in which the parts to be treated are moved on transport elements through the furnace, the space problem present in roller hearth furnaces does not arise, as no space is needed for the changing of the rolls adjacent to the furnace. However, the disadvantage exists that the transport elements must be heated during their passage through the furnace. This fact is not altered by the provision of rotating rollers in lateral spacers either. These elements cannot be used for roller hearth furnaces, in which the rollers are stationary, because in view of the guides for the grate-like transport elements, which are mounted exclusively inside the furnace, the stationary rollers could not be exchanged.

It is, therefore, an object of the invention to provide a roller hearth furnace of the above-mentioned type such that the spacing between the rollers may be minimized while using the smallest possible roller diameters, without causing stability problems in the furnace walls or difficulties relative to the replacement of the rollers.

SUMMARY OF THE INVENTION

This object is attained by the present invention which relates to a roller hearth furnace for the heat treatment of parts passing therethrough. The furnace includes a thermally insulated housing forming a heating space therein. A plurality of roller modules is removably mounted in the housing for transporting parts longitudinally through the heating space. The modules are successively arranged along the direction of travel of the parts. Each module includes a pair of transversely spaced apart bearing beams removably supported in recesses formed in the housing, and a plurality of rotatably driven rollers having their ends supported by the bearing beams. The rollers extend transversely of the direction of travel of the parts and are successively arranged along such direction of travel.

This configuration provides the advantage that the load bearing capacity of the lateral furnace walls is independent of the diameter of the rollers and the spacing therebetween, as well as being independent of the spacing between the supporting points of the rollers, as the latter are held in separate supporting beams, which together with the rollers constitute modular units forming a roller bed. The supporting beams for the rollers may be made of a significantly stronger material relative to the materials used heretofore for the lining of the lateral walls, so that in spite of the tightly arranged rollers they are strong enough to absorb the supporting forces of the lateral walls.

It is feasible by virtue of the invention to minimize the spacing between adjacent rollers, which themselves may have small diameters. This leads to certain difficulties in the production and maintenance of a uniform furnace atmosphere, as the passage of hot gases from the space under the roller bed into the space above it, is restricted. It is, therefore, appropriate to provide means for circulating gases between portions of the heating space disposed above and below the rollers. Thus, a forced circulation of the furnace atmosphere is achieve, with the spaces between the rollers serving to assure that the passage of air through the roller bed (due to the forced circulation) is uniform throughout the length of the module.

Preferably, the housing includes transversely spaced longitudinal walls. The recesses are formed in the walls and extend completely transversely therethrough to permit respective ones of the modules to be inserted into and removed from the housing. Each of the recesses is longitudinally offset relative to a recess in the opposite wall, whereby the recesses in each wall are spaced apart longitudinally by a distance at least equal to a longitudinal dimension of a module. As a result, the bearing capacity of the longitudinal walls does not depend upon the strength of the support bearing beam. That is, each of the longitudinal walls includes a web of considerable width disposed between longitudinally successive ones of the recesses.

Preferably, a framework is provided which is mountable in the housing. That framework defines the recesses into which the modules are insertable. That framework, together with the modules, may comprise a prefabricated unit which can be installed into the furnace housing. Preferably, each of the bearing beams comprises a gear box including a drive mechanism interconnected to the rollers of the associated roller module. Preferably, the framework includes hollow elements adapted to conduct cooling fluid, thereby providing a cooling effect in a simple and effective manner.

It is preferred that thermal insulation be disposed between each bearing beam and the heating space. A supporting beam is disposed between the insulation and the heating space. The supporting beam and insulation have openings through which the rollers extend. Such an arrangement provides a high degree of thermal insulation, and the supporting beam provides added bearing capacity for the rollers.

It is preferred that the rollers are hollow and contain journals telescoped into open ends thereof. The journals are mounted on the bearing beams. As a result, the roller modules are relatively light in weight.

Preferably, one of the journals of a respective module is driven, and the remaining journals are connected to the driven journal to be driven thereby. Such an arrangement makes it possible to vary the velocities of the rollers of the various modules, e.g., the rollers of the module located nearest to the furnace outlet can be increased to discharge the parts more rapidly. Alternatively, all of the rollers can be driven together by means of a known chain drive.

BRIEF DESCRIPTION OF THE DRAWING

The objects and advantages of the invention will become apparent from the following detailed description of preferred embodiments thereof in connection with the accompanying drawings, in which like numerals designate like elements, and in which:

FIG. 1 is a schematic longitudinal sectional view through a roller hearth furnace;

FIG. 2 is a horizontal sectional view through the roller hearth furnace along the line II—II in FIG. 1;

FIG. 3 is a cross-sectional view through the roller hearth furnace along the line III—III in FIG. 2;

FIG. 4 is an enlarged top plan view of a roller module according to the invention;

FIG. 5 is a partial sectional view through the roller bed elements along the line V—V in FIG. 4;

FIG. 6 is an end view of a roller module as viewed in the direction of the arrow VI in FIG. 4;

DETAILED DESCRIPTION OF PREFERRED EMBODIMENTS OF THE INVENTION

Figure 7:
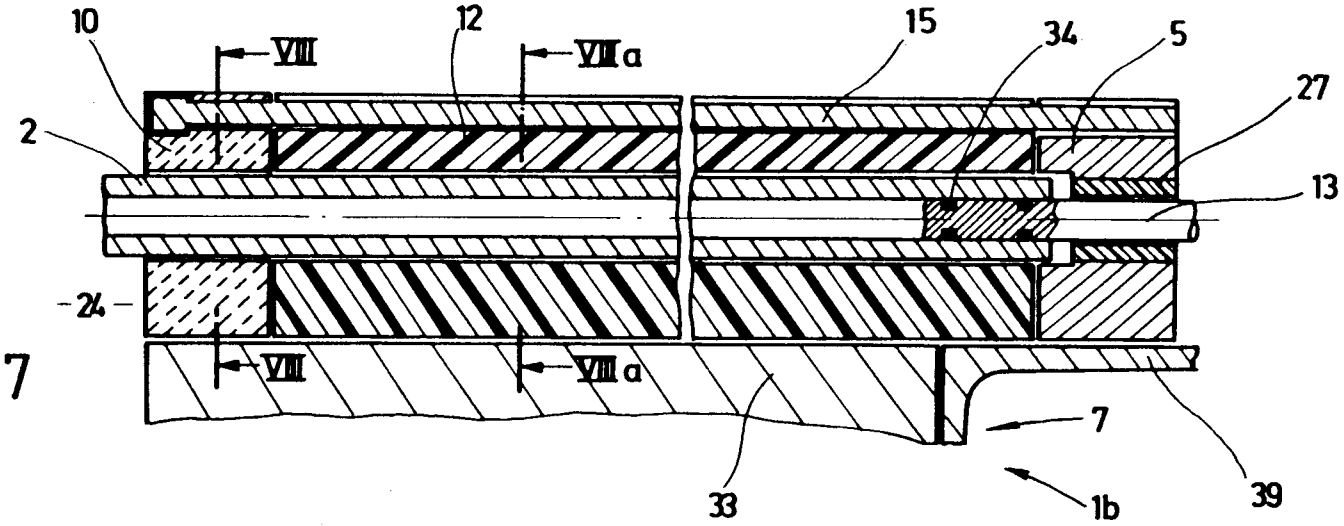
FIG. 7 is a vertical sectional view taken through the right hand bearing end of a roller module in a direction parallel to the roller axes.

FIGS. 1 to 3 show a roller hearth furnace equipped with a housing 1 of refractory and thermal insulating materials and comprising an upper housing part 1*a* and a lower housing part 1*b*. As seen in FIG. 3, the lower part 1*b* is narrower than the upper part 1*a*, so that the upper part 1*a* laterally projects beyond the longitudinal sides of the lower part 1*b* as viewed in the transport direction 21 of the parts through the housing 1. The advantages of this configuration are discussed below.

The housing 1 comprises an internal space 24 heated by the heating devices 23 and containing a roller bed 3 for the conveyance of the parts (not shown) to be treated.

As seen in FIGS. 1 and 2, the roller bed 3 comprises a plurality of roller assemblies or modules 4, e.g., five, located successively in direction 21 and disposed closely adjacent each other in a common plane. The roller modules 4 are held laterally (FIG. 3) in recesses 6 of the housing walls 7 and 7' and are thereby anchored stationarily in the housing 1.

Each of the roller modules 4 comprises, as shown in FIGS. 4 and 5, a plurality of tubular rollers 2 whose ends are supported rotatingly in bearing beams 5. This may be affected by inserting journals 13 telescopingly into the open ends 2*a* of the rollers 2, the journals being held rotatingly in bushing 27 located within the bearing beams 5. The bearing beams 5 are, in turn, connected fixedly with supporting beams 10 by means of fastening anchors 15, which further are correlated toward the center of the rollers with each of the bearing beams 5. These supporting beams serve simultaneously as a thermal shield against the treating chamber 24 in the furnace and as wear-resistant stop edges for the material to be treated. As they must be made of a highly refractory material, it is convenient not to have them correspond in their length to the length of the bearing beams 5, but to associate two supporting beams 10 with each bearing beam 5. Shorter structural lengths may be obtained more readily with highly refractory materials, for example SiC. It is also possible to make very narrow webs, such as the webs 10*a* between the openings for the rollers 2 of such a material.

Each of the supporting beams 10 and of the bearing beams 5 comprises as many openings as there are rollers 2 assigned to a roller assembly 4. Insulating fitting pieces 12 are set between the supporting beams 10 and the bearing beams 5, their function being to provide good thermal insulation for the internal space 24. These insulating fitting pieces 12 are made of two half-sections 12*a* and 12*b*, to avoid the presence of webs such as the webs 10*a* because such webs cannot be made of thermal insulation material for reasons of mechanical strength.

In the embodiment of FIGS. 4 and 5, a common drive unit 25 for the rollers is associated with one of the two bearing beams 5, whereby each of the journals 13' is rotatably driven by appropriate gears 28. The gears 28 are interconnected in rotation such that all of the journals 13' rotate in the same direction. The gears 28 are driven by a common drive journal 26, which, in turn, may be driven by a drive motor 29 associated with the roller assembly 4. As shown in FIG. 2, in the case of the roller hearth furnace of FIGS. 1 to 3, in which five roller modules 4 are provided, five drive motors 5 are therefore present, all of which are located outside the housing 1 and separated from the heated internal space 24 by the supporting beams 10 and the insulating fitting pieces 12 and the bearing beams 5.

In the configuration according to FIGS. 1 to 3, openings 9 are provided in the housing walls 7 and 7', through which the roller assemblies 4 may be retracted outwardly transversely relative to the direction of transport 21, to be serviced or replaced. For this purpose, the openings 9 are adapted in their width and height to the dimensions of the bearing beams 5. Closure covers 30 (FIG. 2) are provided which maintain the drive motors 29, the drive units 25, and the bearing beams 5 in their correct position. The openings 9 on each longitudinal side of the furnace are not aligned with openings 9 on the opposite side. Rather, the openings in one side are longitudinally offset from those in the other side whereby longitudinally successive ones of the roller modules are inserted from opposite sides of the furnace. Thus, between the openings 9 thick and wide wall parts 31 are provided, which are capable of assuring the necessary stability of the furnace structure. It is further possible to provide an external supporting frame 39, whereby the upper housing part 1*a* may be supported on the lower housing part 1*b*. Tie rods 32 extending downward from the upper part of the housing may be used to lift the insulation 12 from the bearing beams 5 and the supporting beams 10, if it is desired to dismantle and remove the corresponding roller modules 4.

The configuration according to the invention provides a roller hearth furnace with a continuous roller bed, in which the structure of the longitudinal walls of the housing 1 is relatively independent of the size and relative positioning of the rollers. The rollers are supported in separate structural parts, and as seen in FIG. 6, it is possible in this manner to arrange the rotatable rollers 2 at small distances from each other. This is possible, because there is no need to take into consideration the outer supporting and insulating structure of the housing 1 in accordance with the present invention.

Because the supporting beams 10 are spaced apart transversely from the bearing beams 5, and the supporting beams 10 are flush with the internal wall boundary of the treating chamber 24, the deflection capacity of the rollers 2 can be kept as small as possible. Smaller roller diameters may therefore be used which, together with the small spacing between the rollers, makes the roller bed 3 highly suitable for the transport of small parts to be treated. The distances between the rollers is appreciably smaller than their diameters.

Figure 8A:
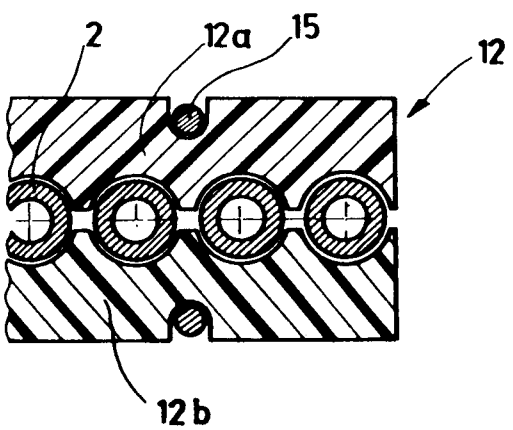
FIG. 8 and 8*a* are vertical sectional views taken along lines VIII and VIII*a* in FIG. 7.
Figure 8:
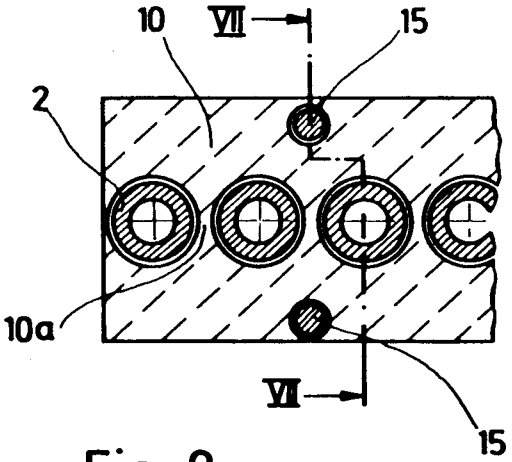

Details of the bearing support of the rollers 2 can be seen in FIGS. 7 and 8. It may be observed that the journals 13 engaging the ends of the hollow rollers 2 are fixedly joined to them for rotation. Further, the supporting beams 10, the insulating fitting pieces 12, and a part of the ceramic anchor 15 extend above the rear of the insulation 33 of the lower part 1*b* of the housing and of the upper part 1*a* of the housing (not shown). The bearing beams 5 are located in the area above an external support structure 39 of the lateral wall 7, the underside of which structure 39 is exposed to ambient air. The area in which the bearing beams 5 are located will therefore remain or may be maintained considerably cooler than the rest of the bearing zone for the rollers 2.

Figure 9:
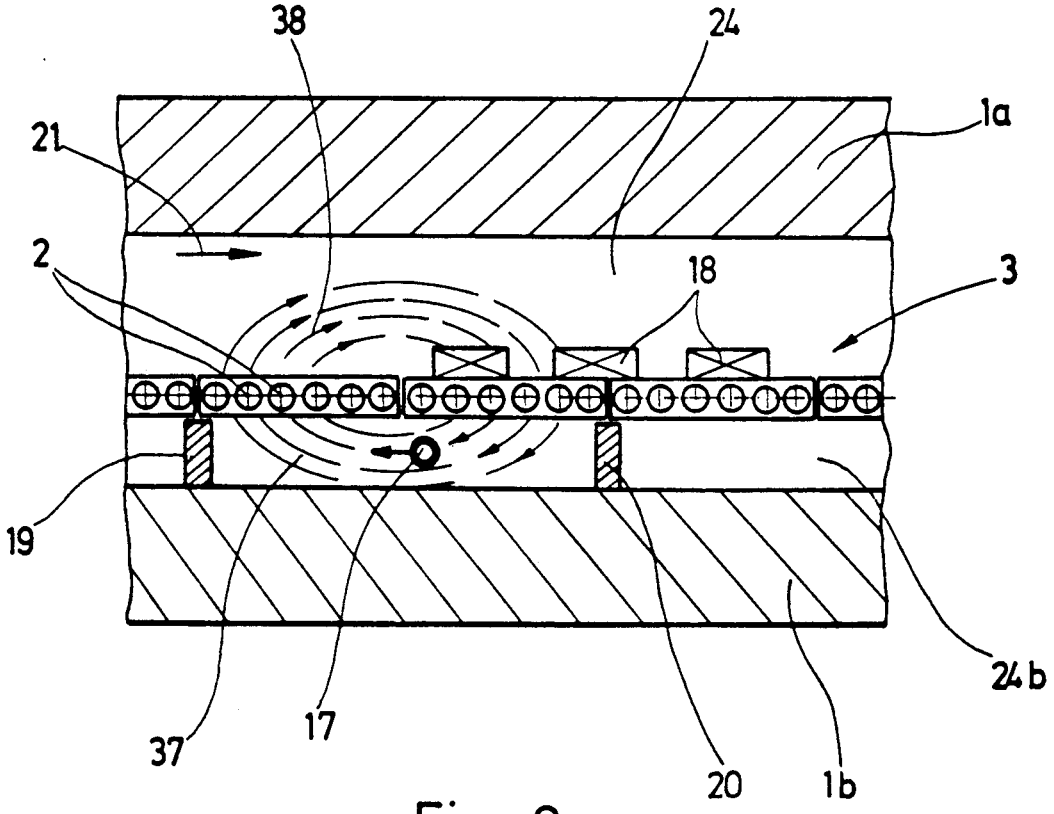
FIG. 9 is a schematically enlarged longitudinal section through the internal space of a roller hearth furnace equipped with gas circulating means.

Since the spacing between the rollers 2 is very small and significantly smaller than the diameter of the rollers, there may be problems within the treating chamber 24 relative to the generation of a uniform furnace atmosphere. The part of the internal space 24 located under the roller bed 3 is separated from the space above it and the possible interchange of the atmosphere within the treating chamber 24 is limited by the narrow distances between the rollers 2. This problem is overcome by the invention wherein, as can be seen in FIG. 9, a gas supply nozzle 17 is mounted in the space 24*b* under the roller bed 3, which nozzle is preceded and followed in the longitudinal transport direction 21 by transverse bulkheads 19 and 20. Thus, a chamber 37 is created under the roller bed so that when gas is introduced by means of the nozzle 17, vertically spaced regions above and below the rollers have, respectively, lower and high pressures, whereby a circulation in the direction of the arrows 38 is generated. This expedient is used to equalize the furnace atmosphere, so that small parts 18 are exposed in the course of their passage through the treating chamber 24 to conditions that are as uniform as possible. The roller bed 3 acts in this layout as a gas distributor to assure that the gas moving upward from the space 37 arrives in a uniform manner in the space above the roller bed 3.

Figure 10:
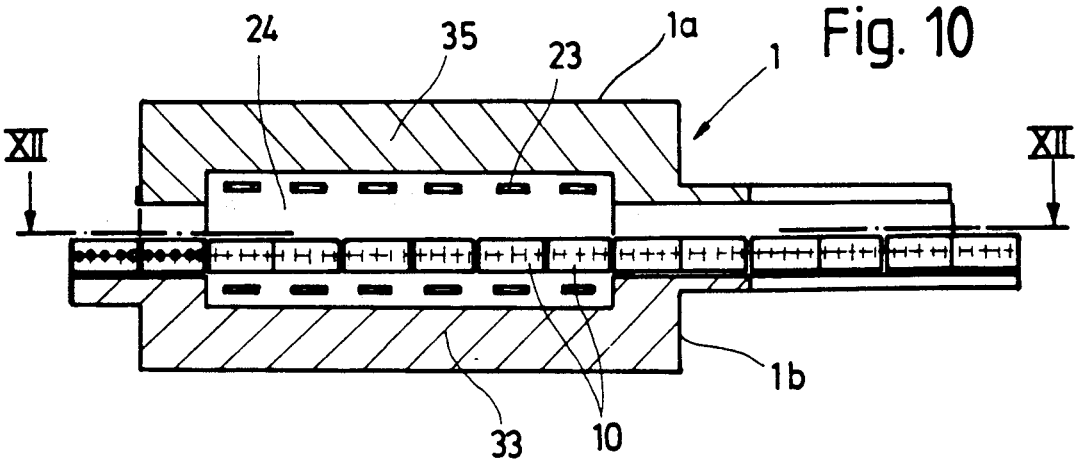
FIG. 10 is a longitudinal sectional view similar to FIG. 1 through a roller hearth furnace according to a second embodiment of the invention.
Figure 11:
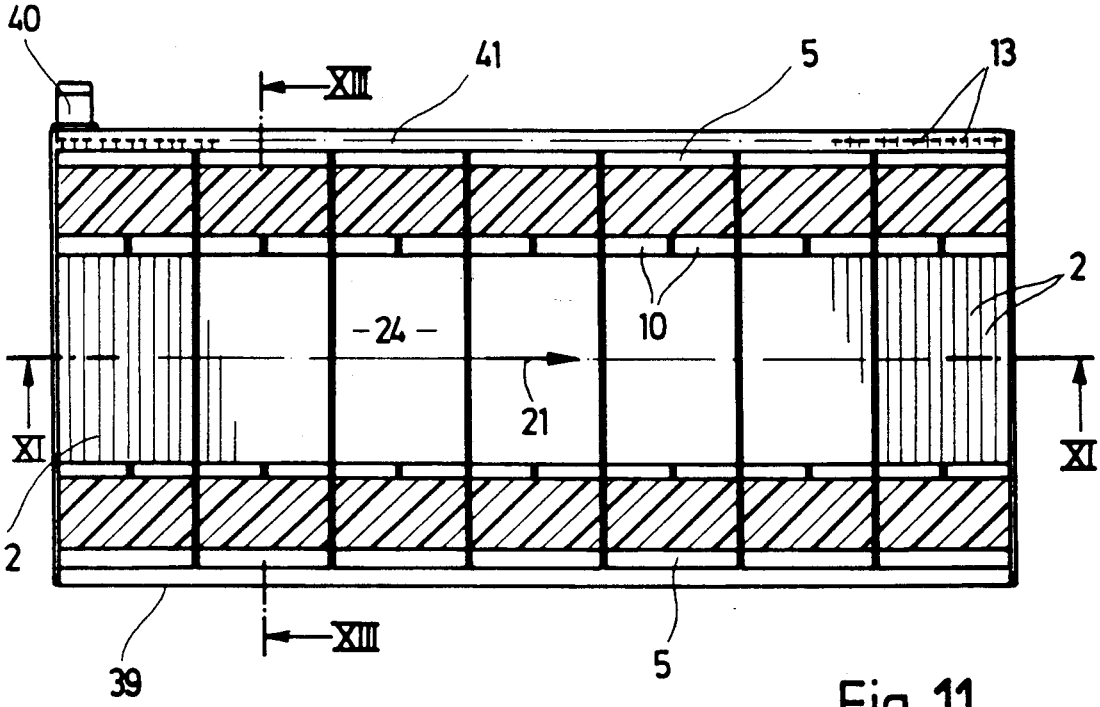
FIG. 11 is a horizontal sectional view through the roller hearth furnace along the line XII—XII in FIG. 10.
Figure 12:
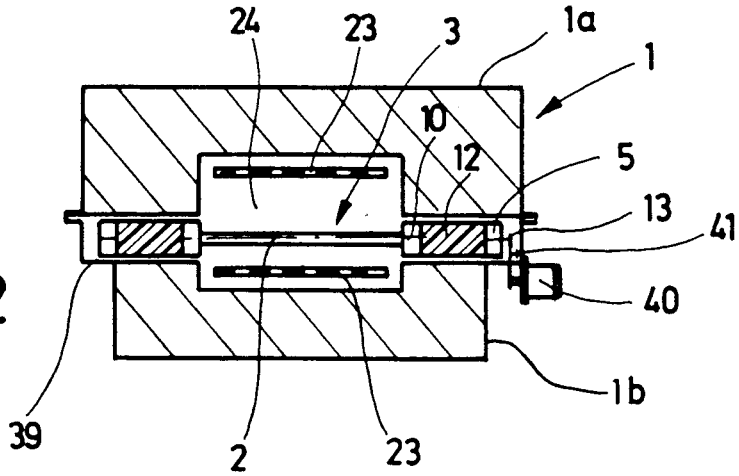
FIG. 12 is a cross-sectional view through the roller hearth furnace along the line XIII—XIII in FIG. 11.

FIGS. 10 to 12 show a slightly modified embodiment in which seven consecutive roller modules 4 are provided which are arranged basically in the manner of the roller modules described in connection with FIGS. 5–6. A difference, however, involves the fact that in the furnace of FIGS. 10–12 the roller modules do not possess their own individual drive units 24 so as to be suitable for hardening, deformation and the like. Rather, in FIGS. 10 to 12, a furnace with a cooling distance for annealing and sintering is shown, in which all of the roller modules are equipped with a continuous single drive for the rollers 2. Thus, in contrast to the embodiment of FIGS. 1 to 3, here in FIGS. 10–12, only one drive motor 40 is provided for all of the rollers 2. Driving power is provided by means of a common chain 41 running in the area of one of the lateral walls of the housing 1, which engages the corresponding gears of each of the individual journals 13, thereby rotating them. Different drive modes are also possible. This rotating motion is then transmitted to the rollers by means of the frictional contact of the journals 13 with the rollers 2 as shown in FIG. 7. In the embodiment according to FIGS. 10 to 12, the rollers 2 are driven in a continuous, uniform manner. The embodiment according to FIGS. 1 to 3, on the other hand, makes it possible to increase and reduce the transport velocity.

Figure 13:
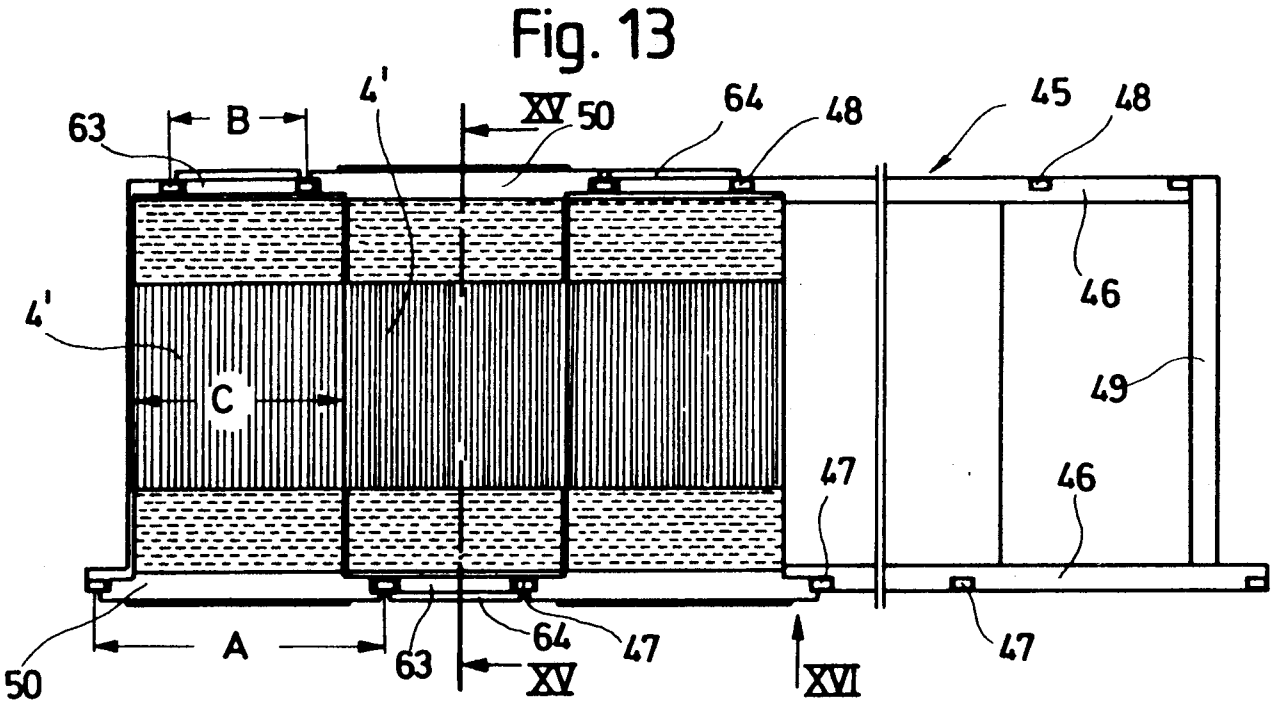
FIG. 13 is a top plan view of a metal installation frame, into which the roller modules are inserted in the manner of drawers.
Figure 14:
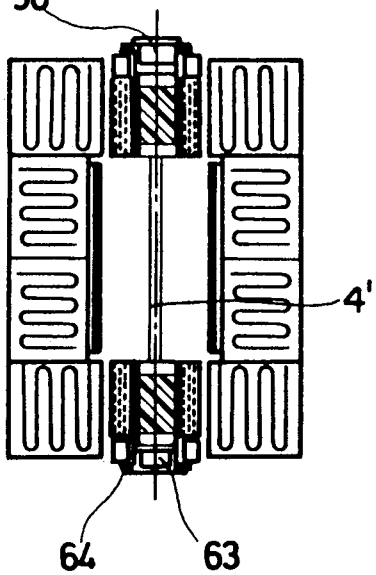
FIG. 14 is a schematic cross-sectional view through the installation frame of FIG. 13 after it has been installed into a furnace housing.
Figure 15:
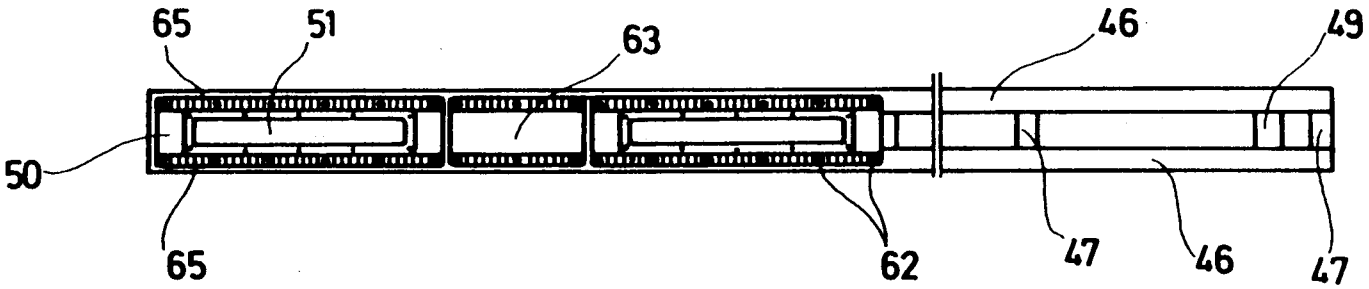
FIG. 15 is a side view of the installation frame as viewed in the direction of the arrow XVI in FIG. 13.

FIG. 13 shows an installation framework 45 made of metal shapes, which may be built in a manner not shown in detail into a thermally insulating housing. The installation framework 45 has on each of its longitudinal sides two parallel longitudinal bars 46 connected with each other by means of perpendicular transverse webs 47 and 48. The transverse webs 47 are located on one longitudinal side and the transverse webs 48 on the other side of the installation framework 45. The longitudinal bars 46 are joined into a frame by transverse bars 49. As seen in FIG. 13, two adjacent transverse webs 47 are spaced apart by a large distance A, while the next two adjacent webs 47 are spaced apart by a smaller distance B, and so on. This is true also of the webs 48, except that the distances A on each side are situated opposite the distances B on the other side. In this manner, a plurality of drawers corresponding to the openings 9 in the preceding embodiments is created in the installation framework 45, into which the roller modules 4' may be inserted in the manner of drawers, with successive roller modules 4' being inserted from opposite longitudinal sides of the installation framework 45. The distance A is chosen so that it is larger than the width C of the roller table element 4'. The distance B, on the other hand, is smaller than the width C, so that upon the insertion of a roller module 4' between two transverse webs located at a distance A, the opposite pair of transverse webs can act as stops.

Figure 16:
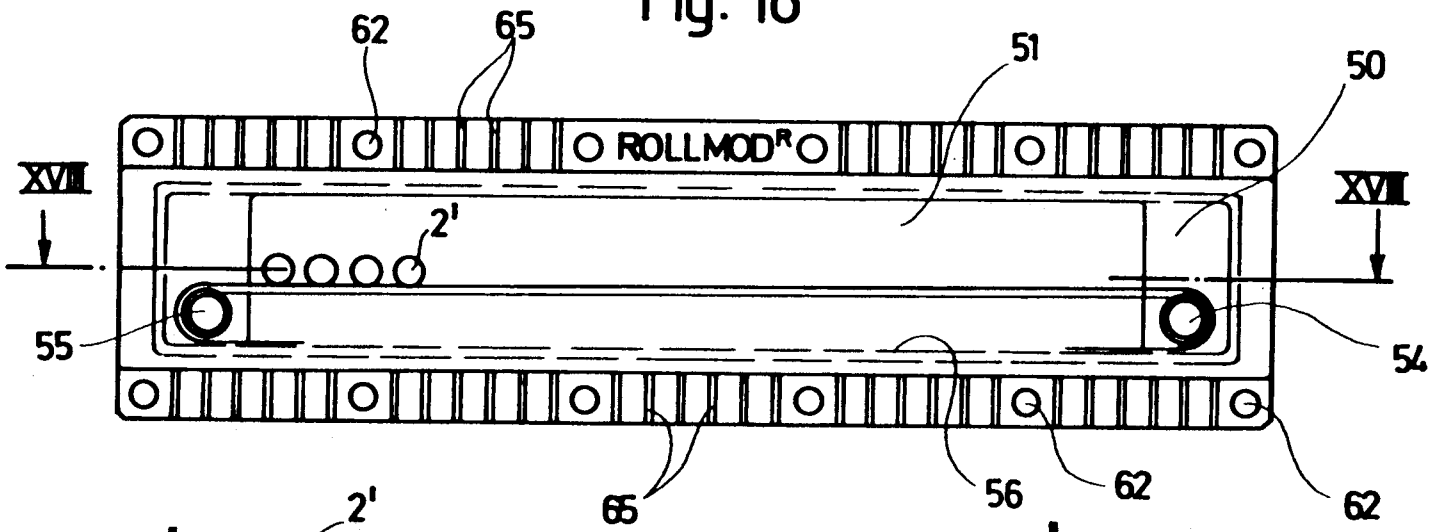
FIG. 16 is an enlarged partial side view of a closing element of the structure of a roller bed inserted in the installation frame of FIG. 13.
Figure 17:
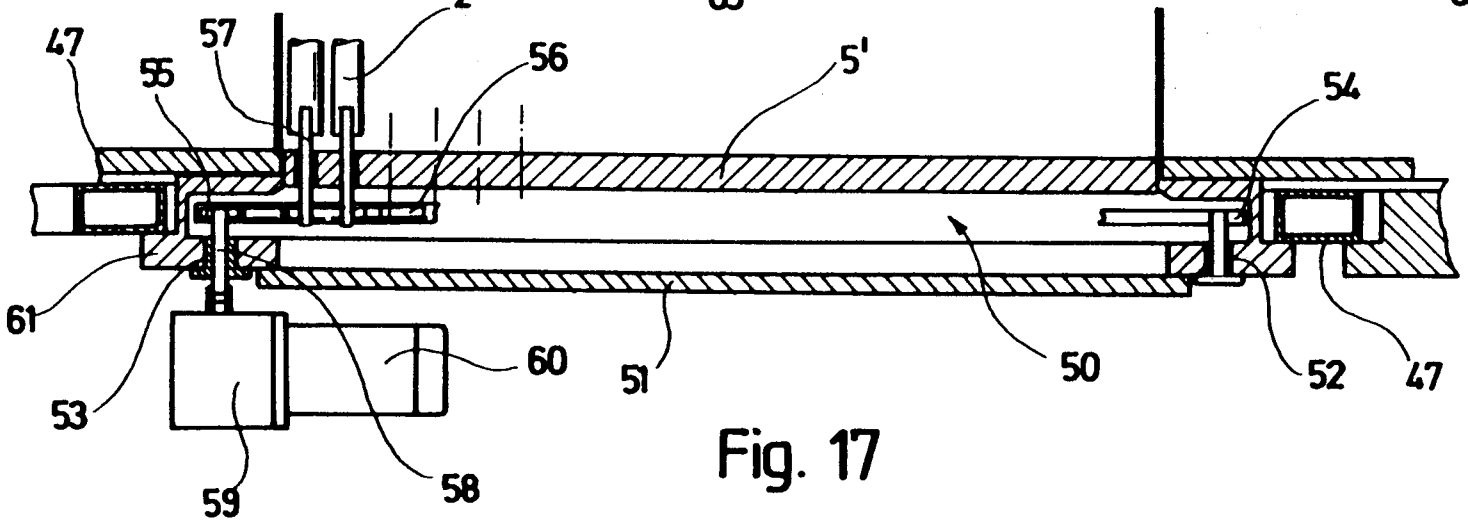
FIG. 17 is a horizontal sectional view taken along the line XVIII of FIG. 16 through the closing element of FIG. 16.

Each of the roller modules, as seen in particular in FIGS. 16 and 17, is equipped on the side correlated with the insertion side with a bearing beam 5', which forms part of a gear box 50 that is closed on its outer side by a cover 51. Laterally adjacent to the cover 51 the bear box 50 is provided with bearings 52 and 53 for supporting reversing wheels 54 and 55 of a drive chain 56, which, similarly to the embodiment according to FIGS. 1 to 3, drives the journals 57 associated with the roller modules 4' of all of the rollers 2'. The reversing wheel 54 is supported rotatingly on a bearing bolt mounted on the gear box 50. The reversing wheel 55 drives the chain 56 and is connected by means of a drive shaft 58 with the gear 59 of a drive motor 60.

As shown in FIGS. 16 and 17 and 13 to 15, the roller modules 4' may be inserted from one side into the installation frame 45, until the lateral flanges 61 thereof abut against the associated transverse webs 47. In this position, the roller modules may be fastened to the longitudinal bars 62 by screws (not shown), which screws being inserted through the corresponding bores 62. From the other side, the position is closed-off and secured by the insertion of a closure cap 63 (FIG. 13) into the space between the two transverse webs separated by the distance B and fastened by screws to an extension of or directly to the bearing beam of the roller assembly 4' provided on this side. The closure cap has an outer flange 64 extending over the associated transverse webs 48 and 47 spaced apart by distance B.

The gear boxes 50 may be equipped with cooling ribs 65 in their upper and lower areas. It is possible to project heating or cooling elements upward or downward relative to the gear boxes 50 or the closure cap 63 in a manner similar to the cooling elements 22 in the embodiment of FIGS. 1-3. Those cooling elements serve to cool the gear box 50 and the drive parts contained therein. It is advantageous for this purpose to form the longitudinal bars 46 and/or the transverse bars 47, 48 in the form of hollow shapes to conduct a flow of cooling air therethrough. The cooling air would be passed through blowers located at one or several suitable points in one or several of the hollow shapes.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A roller hearth furnace for the heat treatment of parts passing therethrough, comprising:

a thermally insulated housing forming a heating space therein, and a plurality of roller modules removably mounted in said housing for transporting parts longitudinally through said heating space, said roller modules being successively arranged along a direction of transport of the parts, each roller module including:

a pair of transversely spaced apart bearing beams removably supported in recesses formed in said housing, and a plurality of rotatably driven rollers having their ends supported by said bearing beams, said rollers extending transversely of the direction of travel of the parts and being successively arranged along such direction of transport, said rollers being rotatable about stationary axes and being removable from said heating space along with said bearing beams in a direction transversely of said direction of transport.

2. A roller hearth furnace according to claim 1, wherein said housing includes transversely spaced longitudinal walls, said recesses formed in said walls and extending completely transversely therethrough to permit respective ones of said modules to be inserted into and removed from said housing.

3. A roller hearth furnace according to claim 2, wherein said recesses in one wall are longitudinally offset relative to said recess in the opposite wall whereby the recesses in each wall are spaced apart longitudinally from one another by a distance at least equal to a longitudinal dimension of one of said modules.

4. A roller hearth furnace according to claim 1 including a prefabricated framework which is mounted in said housing, said framework defining said recesses.

5. A roller hearth furnace according to claim 4, wherein said framework includes first and second transversely spaced pairs of longitudinally extending, vertically spaced bars, each pair of bars being interconnected by webs, said bars and webs defining said recesses.

6. A roller hearth furnace for the heat treatment of parts passing therethrough, comprising:

a thermally insulated housing forming a heating space therein, and a plurality of roller modules removably mounted in said housing for transporting parts longitudinally through said heating space, said roller modules being successively arranged along a direction of transport of the parts, each roller module comprising:

a pair of transversely spaced apart bearing beams removably supported in recesses formed in said housing, and a plurality of rotatably driven rollers having their ends supported by said bearing beams, said rollers extending transversely of the direction of travel of the parts and being successively arranged along such direction of transport, said housing including transversely spaced longitudinal walls, said recesses formed in said walls and extending completely transversely therethrough to permit respective ones of said modules to be inserted into and removed from said housing, said recesses in one wall being longitudinally offset relative to said recess in the opposite wall whereby the recesses in each wall are spaced apart longitudinally from one another by a distance at least equal to a longitudinal dimension of one of said modules.

7. A roller hearth furnace for the heat treatment of parts passing therethrough, comprising:

a thermally insulated housing forming a heating space therein, a plurality of roller modules removably mounted in said housing for transporting parts longitudinally through said heating space, said roller modules being successively arranged along a direction of transport of the parts, each roller module including:

a pair of transversely spaced apart bearing beams removably supported in recesses formed in said housing, and a plurality of rotatably driven rollers having their ends supported by said bearing beams, said rollers extending transversely of the direction of travel of the parts and being successively arranged along such direction of transport, and a prefabricated framework mounted in said housing, said framework defining said recesses, said framework including first and second transversely spaced pairs of longitudinally extending, vertically spaced bars, each pair of bars being interconnected by webs, said bars and webs defining said recesses.

8. A roller hearth furnace for the heat treatment of parts passing therethrough, comprising:

a thermally insulated housing forming a heating space therein, a plurality of roller modules removably mounted in said housing for transporting parts longitudinally through said heating space, said roller modules being successively arranged along a direction of transport of the parts, each roller module including:

a pair of transversely spaced apart bearing beams removably supported in recesses formed in said housing, and a plurality of rotatably driven rollers having their ends supported by said bearing beams, said rollers extending transversely of the direction of travel of the parts and being successively arranged along such direction of transport, thermal insulation disposed between each bearing beam and the heating space, and a supporting beam disposed between said insulation and said heating space, said supporting beam and insulation having openings through which said rollers extend.

9. A roller hearth furnace according to claim 7, wherein there is a plurality of longitudinally spaced webs interconnecting each said pair of bars, a first pair of said webs being longitudinally spaced by a distance at least equal to the corresponding dimension of a roller module to permit said roller module to be inserted into and removed from the housing, a second pair of said webs being longitudinally spaced apart by a distance less than said corresponding dimension of a roller module whereby said other webs define stops for a roller module inserted between a first pair of webs on the opposing side of said framework.

10. A roller hearth furnace according to claim 9 including a closure cap extending between said second pair of webs.

11. A roller hearth furnace according to claim 7, wherein each of said bearing beams comprises a gear box including a drive mechanism interconnected to said rollers of the associated roller module.

12. A roller hearth furnace according to claim 4, wherein said framework includes hollow elements adapted to conduct cooling air.

13. A roller hearth furnace according to claim 1 including thermal insulation disposed between each bearing beam and the heating space.

14. A roller hearth furnace according to claim 13 including a supporting beam disposed between said insulation and said heating space, said supporting beam and insulation having openings through which said rollers extend.

15. A roller hearth furnace according to claim 8 including fastening anchors interconnecting associated ones of said bearing beams and supporting beams.

16. A roller hearth furnace according to claim 1, wherein said rollers are hollow and contain journals telescoped into open ends thereof, said journals being mounted on said bearing beams.

17. A roller hearth furnace according to claim 16 including means driving one of said journals of a respective roller module.

18. A roller hearth furnace according to claim 17, wherein remaining ones of said journals of said last-named module are connected to said driven journal to be driven thereby.

19. A roller hearth furnace according to claim 1 including circulating means for forcibly circulating gases between portions of said heating space disposed above and below said rollers.

20. A roller hearth furnace according to claim 17, wherein said circulating means comprises a tubular nozzle, transverse bars being disposed ahead of and behind said nozzle to form a gas circulation zone in said heating space.

* * * * *